US007114885B2

(12) United States Patent
Løset et al.

(10) Patent No.: US 7,114,885 B2
(45) Date of Patent: Oct. 3, 2006

(54) PROTECTION MEANS FOR A FLEXIBLE RISER

(75) Inventors: Sveinung Løset, Trondheim (NO); Ove Tobias Gudmestad, Nærbø (NO)

(73) Assignee: Statoil Asa, Stavanger (NO)

( * ) Notice: Subject to any disclaimer, the term of this patent is extended or adjusted under 35 U.S.C. 154(b) by 0 days.

(21) Appl. No.: 10/528,564

(22) PCT Filed: Aug. 21, 2003

(86) PCT No.: PCT/NO03/00288

§ 371 (c)(1),
(2), (4) Date: Mar. 21, 2005

(87) PCT Pub. No.: WO2004/028895

PCT Pub. Date: Apr. 8, 2004

(65) Prior Publication Data

US 2006/0037757 A1 Feb. 23, 2006

(30) Foreign Application Priority Data

Sep. 24, 2002 (NO) ..... 20024585

(51) Int. Cl.
*B63B 27/34* (2006.01)

(52) U.S. Cl. ..... 405/224.2; 405/224.3; 405/216; 166/359; 166/367

(58) Field of Classification Search ..... 405/224.2, 405/224.3, 224.4, 224, 216, 217, 211; 166/345, 166/359, 367
See application file for complete search history.

(56) References Cited

U.S. PATENT DOCUMENTS

| | | | | |
|---|---|---|---|---|
| 3,612,176 | A | 10/1971 | Bauer et al. | |
| 4,067,202 | A | 1/1978 | Reed | |
| 4,126,183 | A * | 11/1978 | Walker | 166/364 |
| 4,403,658 | A * | 9/1983 | Watkins | 166/367 |
| 4,505,615 | A | 3/1985 | Evans | |
| 4,505,618 | A | 3/1985 | Yashima | |
| 4,624,318 | A * | 11/1986 | Aagaard | 405/211 |

FOREIGN PATENT DOCUMENTS

| | | |
|---|---|---|
| GB | 2066758 A | 7/1981 |
| GB | 2320268 A | 6/1998 |
| NO | 308027 B1 | 10/1994 |

* cited by examiner

*Primary Examiner*—Frederick L. Lagman
(74) *Attorney, Agent, or Firm*—Foley & Lardner LLP

(57) ABSTRACT

The invention relates to flexible risers for transfer of hydrocarbons between a sea bed installation and a vessel (10) floating at the sea surface. The riser (18) is provided with means (20) for protecting the riser (18) from impacts. The protection means (20) covers at least the upper part of the riser (18) and is retractable to an inactive position. When in operation, the riser protection means (20) is either suspended from the vessel (10) or from a submerged turret buoy, forming part of a mooring system for the vessel (10).

17 Claims, 6 Drawing Sheets

PROTECTION MEANS FOR A FLEXIBLE RISER

Norway Priority Application 2002 4585, filed Sep. 24, 2002 including the specification, drawings, claims and abstract, is incorporated herein by reference in its entirety. This application is a National Stage of US Application PCT/NO2003/000288, filed Aug. 21, 2003, incorporated herein by reference in its entirety.

The present invention relates to flexible risers designed to operate in ice infested waters. More particularly, the present invention relates to protection of flexible risers for transfer of hydrocarbons from an installation on the sea bed to a floating vessel in an area exposed to drifting ice. The invention could also be used in areas where other types of drifting obstacles are present, e.g. drifting nets or drifting timber.

BACKGROUND FOR THE INVENTION

Oil exploration has moved into arctic waters. Motion of drifting ice is often a crucial problem when designing and planning an off-take loading and mooring system in ice infested waters. It is imperative to design systems and methods which eliminate the risks for pollution, caused by damage to the equipment due to impact from the drifting ice.

The drifting motion of ice is mainly governed by wind, waves, ocean currents and tidal forces. From analyses for the Eastern Barents Sea, it has been found that on a large time scale the ice drifting motion is clearly stochastic and with the exception of periods with rather straight lined movement, it resembles Brownian motion. Since ice floes are generally large and heavy, the direction and absolute value of their speed cannot change momentarily. Models predict steady motion of the ice, but occasionally the direction of ice drift may change to the opposite direction in roughly half an hour. This is a major concern for the conventional loading concept where the tanker, say 90 000 DWT, is staying in the "wake" behind a platform or a tower extending up above the sea level. If using a submerged loading concept instead in waters subjected to drifting ice, allowing the tanker to "ice-vane", advantages may be achieved.

In ice-infested waters, however, bottom installations might be damaged by deep ice formations (ice ridges in the Pechora Sea, icebergs in some other places).

Tests executed in 1997 and 2000 at the Hamburg Ship Model Basin (HSVA), Germany, testing the Submerged Turret Loading system, STL, in frozen seas, showed that under-keel installations will be in contact with ice as soon as the ice conditions worsens (interactions with ice ridges). Hence, the riser has to be protected from this hazard.

PRIOR ART

U.S. Pat. No. 5,820,429 describes an arrangement of a loading/unloading buoy for use in shallow waters wherein a buoy is arranged for introduction and releasable securement in a downwardly open receiving space in a floating vessel. The buoy comprises a bottom anchored centre member for the passage of fluid from or to a transfer line which is coupled to the underside of the center member. The buoy further comprises an outer member which is rotatably mounted on the center member to allow turning of the vessel about the center member when the outer member is secured in the receiving space. The buoy is provided with a bottom support structure which is connected to the center member of the buoy and arranged for support of the buoy at the sea bed when not in use. To the center member of the buoy there are connected a number of mooring lines extending outwards from the buoy a substantial distance along the sea bed. Such a system has an inherent elasticity allowing raising of the buoy from the sea.

SUMMARY OF THE INVENTION

The object of the invention is to achieve protection for flexible risers employed in ice infested waters, protecting at least the upper part of a riser extending between the sea bed and a floating vessel.

A further object of the present invention is to provide riser protection means which quickly may be retracted to an in-operative position, permitting the riser to be quickly disconnected from its connection point on the sea bed and possibly retracted to a completely protected position where the riser will not be exposed to impact by the drifting ice. Correspondingly, it is an object to achieve a loading system where the loading operation may be quickly aborted and the moored tanker may be quickly released from the mooring system.

According to the present invention the objects are achieved by means of a loading system as further defined in the claims.

BRIEF DESCRIPTION OF THE DRAWINGS

The invention will be further described in detail below in connection with an exemplary embodiment with reference to the drawings, wherein.

DETAILED DESCRIPTION OF THE PREFERRED EMBODIMENT

Figure 1:
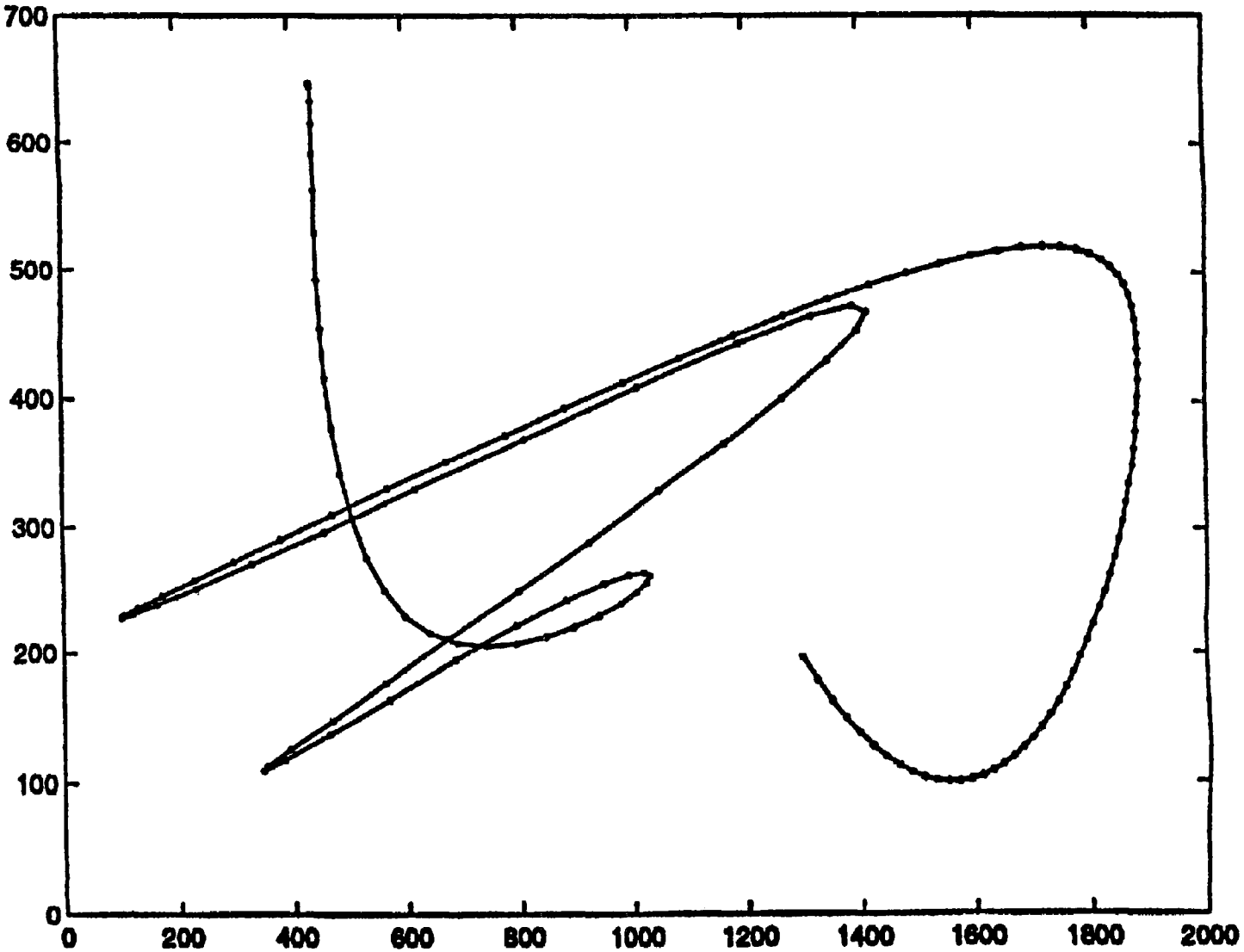
FIG. 1 shows modelled movement of the ice drift.

FIG. 1 shows modelled movements of the ice drift. The increment between each dot on the graph represents a time lapse of 10 minutes. The Figure gives an impression of the movement during a 24-hour period. As indicated on the graph, the model predicts steady motion of the ice. Occasionally, however, the ice drift may change to the opposite direction in roughly half an hour. This is a major concern for the conventional loading concept where the tanker, say 90 000 DWT, is staying in the "wake" behind a platform or a tower extending up above the sea level, as shown in FIG. 2.

Figure 2:
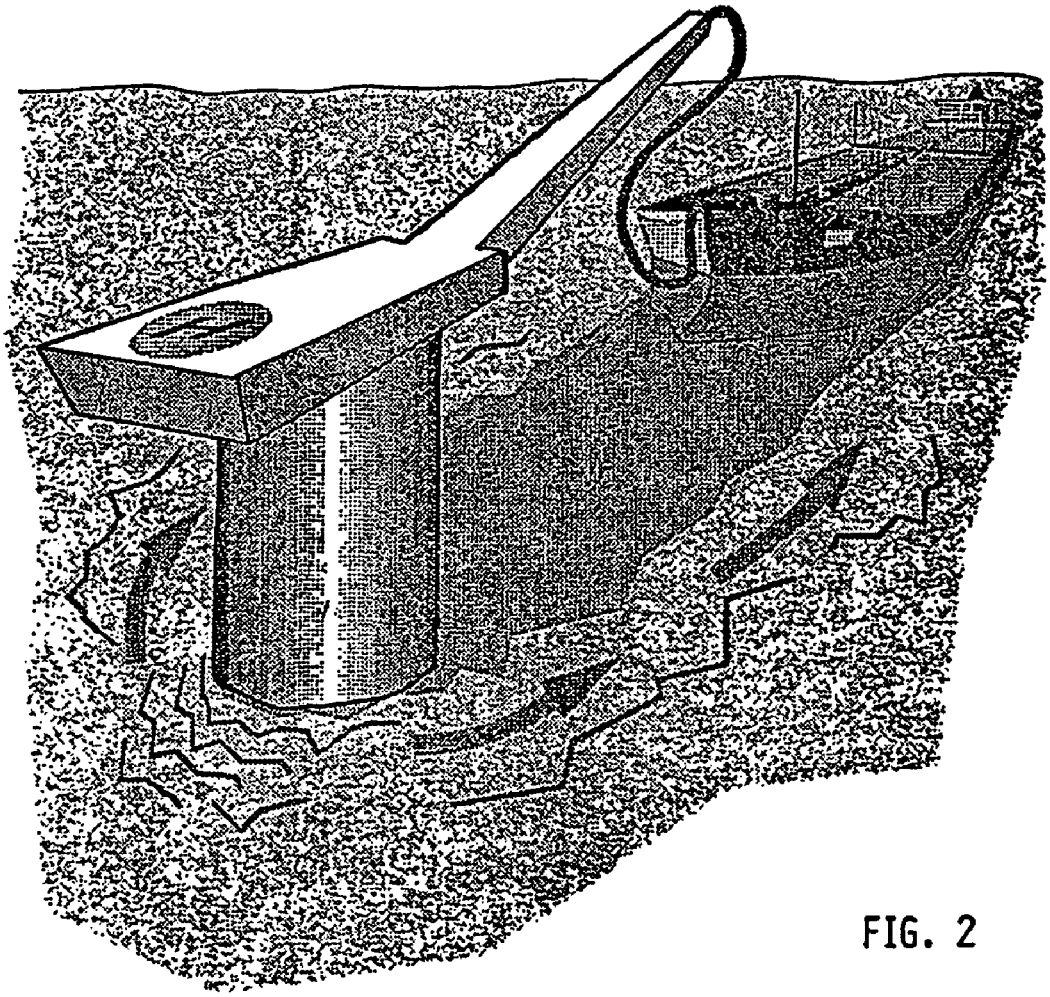
FIG. 2 shows a typical prior art loading system.

In FIG. 2 a tanker vessel 10 is moored to a platform 11 and fluids are transferred from the platform 11 to the vessel 10 through a flexible hose 12. The flexible hose 12 is suspended from a rotatably arranged loading arm 13. Since the vessel is only moored to the platform, the possibility of collision between the vessel 10 and the platform 11 is large if and when the drifting direction of the ice changes abruptly. In such case, the loading operation must stop immediately and the tanker 10 must quickly be released from its mooring system.

In order to overcome such problems, a sub sea loading concept is required, reducing possible interference with the drifting ice, and still allowing the tanker 10 to 'ice-vane' depending on the movement of the drift ice.

Figure 3:
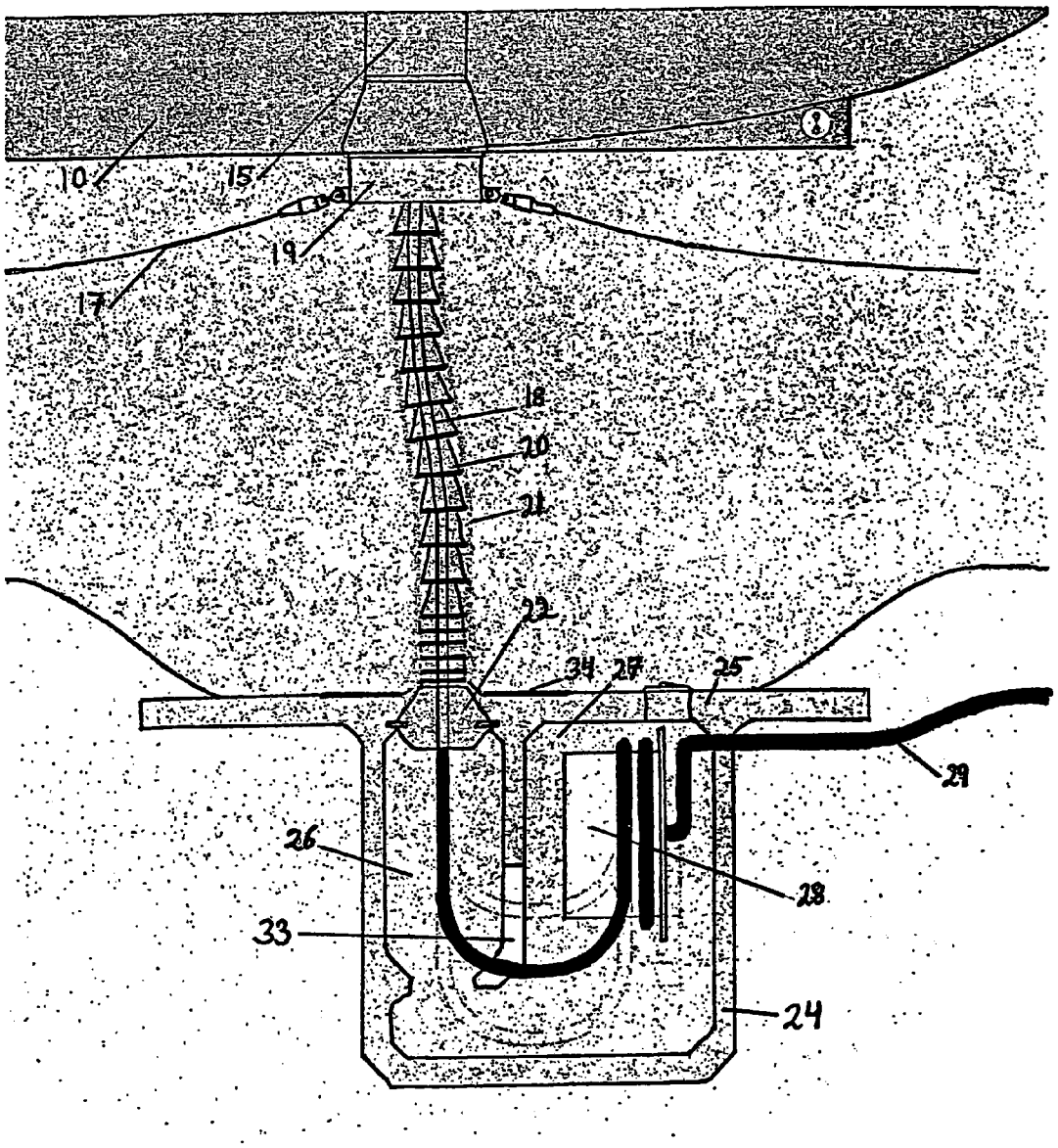
FIG. 3 shows the loading system according to the invention wherein the riser is connected to a vessel.

FIG. 3 shows in principle a preferred embodiment of a loading system according to the invention. As shown in FIG. 3, a vessel 10 is floating on the sea surface. The vessel 10 is equipped with a moon pool 15, and is rotatably moored to the sea bed 16 by means of a plurality of mooring lines 17. A flexible riser 18 extends between the sea bed 16 and the vessel 10. At its upper end the riser 18 is connected to a submerged turret buoy 19. The mooring lines 17 are coupled to the submerged turret buoy 19, allowing the vessel to weather vane. Such turret buoy may be of a type as is further detailed in the applicants U.S. Pat. No. 5,820,429, the content of which hereby is included by reference. The upper end of the riser 18 is releasable connected to a corresponding pipe line onboard the vessel by means of a swivel joint (not shown).

According to the invention, the riser 18 is protected by a riser protection means 20. According to the embodiment shown in FIG. 3 the upper end of the riser protection means 20 is suspended from the submerged turret buoy 19 by means of a plurality of chains, wires or the like 21. The lower end of the riser protection means 20 is coupled to a riser socket 22. According to a preferred embodiment of the invention the riser protection means 20 comprises a plurality of hollow, upwardly truncated conical elements 23, having a smaller upper diameter and a larger lower diameter or vice versa.

Figure 5:
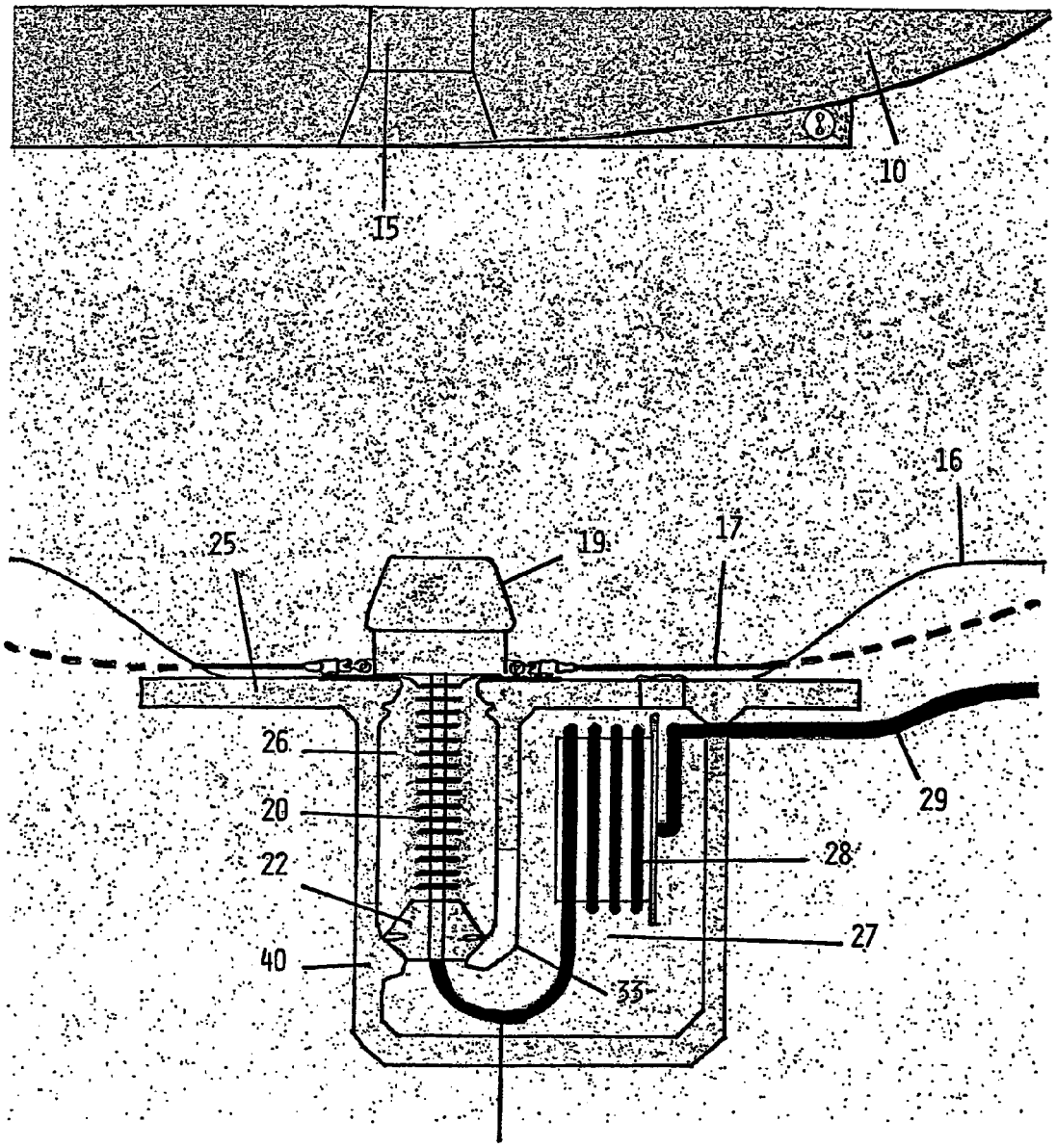
FIG. 5 shows the loading system in a retracted, idle position on the sea bed.

The loading system according to the invention comprises further a bottom installation 24. According to a preferred embodiment of the invention the bottom installation 24 is formed by a silo that will store and protect the riser 18 and the riser protection means 20 when the loading system is not in use. The silo 24 is dug into the sea bed 16, a top slab 25 of which being more or less flush with the sea bed 16. Hence, a very small part of the system is exposed on the sea bed when the loading system is retracted to its protected position, ref. FIG. 5.

The silo comprises two main parts; a cell 26 and a main chamber 27. A riser reel 28 is located in the chamber 27. The reel 28 rotates around a horizontal axis (not shown) and at least the lower end of the riser is reeled on to the reel 28. The lower end of the riser 18 is coupled to a pipeline 29 from an oil well or the like. The coupling between the pipeline 29 and the lower end of the riser 18 is provided with a swivel of any conventional type, allowing relative rotation between the pipeline 29 and the riser riser 28.

The top slab 25 may according to an embodiment of the invention be provided with an opening 30 having a shape and a size adapted to the shape and size of the riser socket 22. The top slab 25, at least when used in shallow waters, may be equipped with a manhole 31, allowing access for light maintenance.

A vertical slot 33 is provided in the lower part of a wall 32 dividing the cell 26 and the chamber 27. The height of the slot 33 exceeds the maximum expected heave amplitude of the vessel 10. The width of the slot 33 exceeds the diameter of the riser 18.

In order to minimize soil intrusion into the silo 24 when the loading system is connected to the vessel, flexible deflectors 34 are arranged over the opening 30 for the riser 18 and its protection means 20. Some yearly light maintenance can be performed to remove the soil deposited at the bottom of the silo. The system can also be modified to be soil intrusion proof, if needed.

Figure 4:
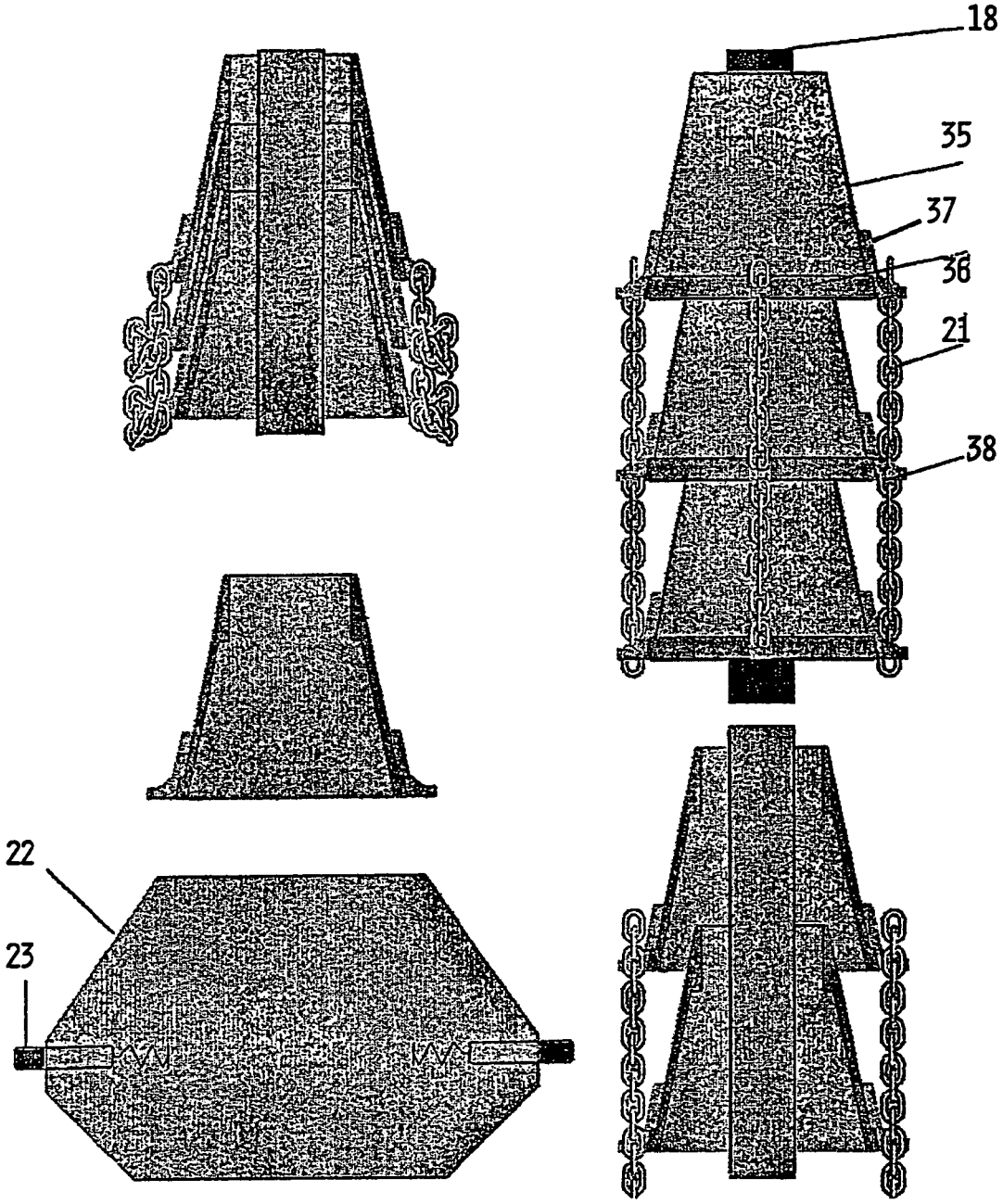
FIG. 4 shows details of the riser protection means.

FIG. 4 shows the parts of the riser protection means 20. As shown on the figure the protection means comprises a plurality of hollow, truncated, conical elements 35. Each element is open ended at both ends. The elements 35 are suspended from each other by means of chains or wires 21. The riser extends through the set of elements 35.

Such riser protection means 20 will resist dragging and impact loads from ice passing under the keel of the vessel. The design of the elements 35 in the riser protection means 20, (ref. FIGS. 3 and 4) will give the required bending capabilities due to suspended, separate elements, and will protect the riser from excessive bending.

Since the elements 35 are suspended to each other, the elements 35, when the riser protection means 29 is lowered, will be stacked into each other. This allows the riser protection means 20 always to have an adequate length. When the vessel is in its mean position, some elements 35 are stacked at the bottom of the riser protection means 20, on top of the silo 24. Consequently, the total length of the riser protection means 20 will be sufficiently long to follow the heave of the vessel 10.

The elements 35 are suspended independently of the riser 18. The riser 18 will thus heave with the vessel 10 and is free to slide within the lower elements 35.

A possible design for the elements 35 is presented in FIG. 4. This design may be varied without deviating from the inventive idea and is only shown to give an idea of the function of the elements 35. On the drawing, chains 21 are used to link the elements 35. It should be appreciated however, that wires or other type of links may be used. The drawing suggests further that four chains 21 are used to link the elements 35. It should be appreciated that the number of chains may be varied, as for example three chains may be suitable.

As further shown on FIG. 4 the lower rim 36 of each element 35 may be provided with an stacking ridge 37 which also includes attachment eyes 38 for the chains 21.

FIG. 4 shows further a schematic view of the riser socket 22. As shown on the Figure the riser socket 22 is provided with locking means 39 intended to interact with corresponding recesses in the top slab 25, thereby interlocking the top slab 25 and the riser socket 22 when in operational mode.

FIG. 5 shows the riser protection 20 means in a retracted position, the riser protection means 20 being in an in-active position within the cell 26 in the silo 24.

Here the submerged turret buoy 19 is resting on the top slab 25, while the riser socket 22 is released from its engagement with the top slab 25, resting on a particularly adapted support 40 at the lower end of the cell 26. In this position the elements 35 are stacked on top of each other, while substantially the entire length of the riser 18 is reeled on to the reel 28 in the chamber 27. As further shown on FIG. 5 the sag bend of the riser 28 extends below the lower end of the slot 33. The mooring lines 17 rest freely on the sea bed 16.

Figure 6:
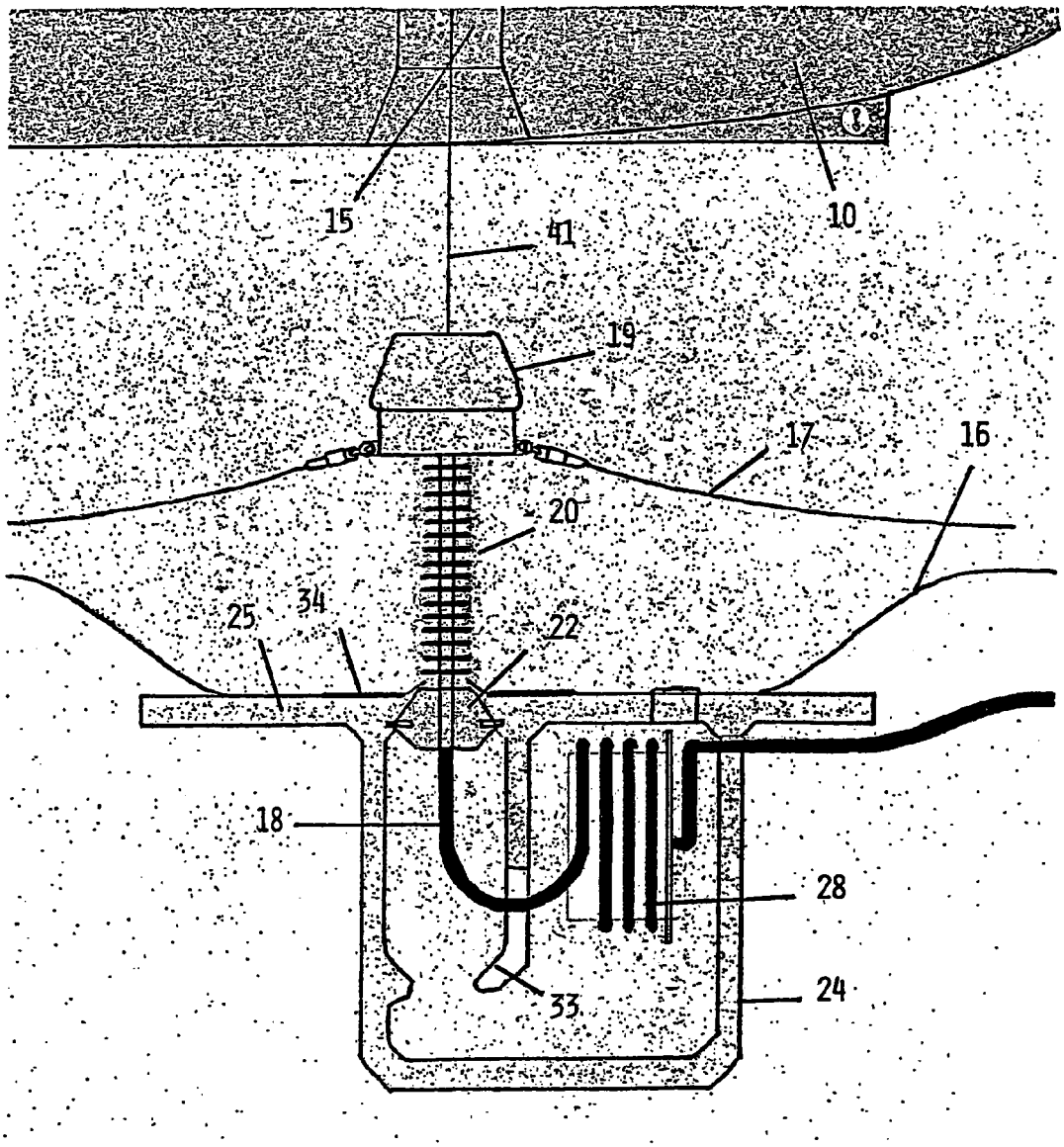
FIG. 6 shows the riser protection in the process of being lifted up from its retracted position towards the vessel.

FIG. 6 shows the loading system in the process of being lifted up towards the vessel 10 by means of a wire 41. As shown, the submerged turret buoy 19 is lifted off the top slab 25 and the riser socket 22 is in a locked position with the top slab 25. The riser 18 is fed out from the riser reel 28 as the submerged turret buoy 19 is lifted upwards.

The system works in the following way:

At first the elements 23 are stored in stacked configuration in the cell 26 of the silo 24. The vessel 10 comes into position over the silo 24 and connects to the system, ref. the situation shown in FIG. 5. It first lifts the buoy and the riser socket 22 off its lower support 40 and then lifts out the whole riser protection means 20 to a position as shown in FIG. 6. The riser socket 22 (details shown in FIG. 4) is then fastened to the top slab 25 of the silo 24, engaging the locking means 39 on the riser socket 22 with corresponding means on the top slab 25. During this first lifting operation, the reel 28 is not rotated; the slack in the riser being sufficient to provide the required length.

The vessel 10 then pulls the submerged turret buoy 19 upwardly into contact and locked engagement with the moon pool 15 on the vessel 10 (FIG. 3). During this phase, the riser 18 is unreeled to a position where the slack in the riser 18 is sufficient to compensate for the heave of the vessel 10. For this purpose a vertical slot 33 is provided in wall of the cell 26, adjacent the reel 28, allowing the riser 18 to move up and down. In FIG. 3 two extreme positions of the riser 18 are shown by dotted lines. When the system is connected to the vessel 10, the reel 28 is not intended to rotate, and consequently does not have to feed out or pull in the riser 18 to follow dynamically the motions of the vessel 10.

For the disconnection phase, the operations are the same in a reverse manner. The system can be designed as "self storable". In case of an emergency disconnection, the whole system may retract automatically into the silo on its own.

For installation and for heavy maintenance, the top slab 25 may be unlocked from the silo and lifted up onboard a barge, vessel or the like.

Above the invention is described in conjunction with a silo arranged on the sea bed. It should be appreciated however, that the invention is not limited to such use. The riser protection means may, for example, be temporary stored in a stacked position on board the vessel, either in conjunction with a turret/moon pool or in conjunction with an arrangement in the bow region of the vessel in case such type of single point mooring systems are used.

In case the riser protection is applied only to the upper part of the riser the riser socket may be omitted, the riser protection means being suspended freely from the vessel.

Alternatively, the riser protection means may be stored on the sea bed in a stacked position, independent of a silo or the like.

An important advantage of this system is its ability to operate in any ice condition. As long as the vessel 10 and the mooring can withstand the incoming sea ice, so will the riser 18, as partly protected under the vessel 10. The vertical elasticity of the system makes it able to cope with quite heavy seas. This loading system will thus have a very high operability rate.

This transfer system is independent of the methods used for connection to the vessel 10. It is very suitable for the STL system for example, but may also be employed in other systems. It could for example be adapted to be used as a Single Anchor Mooring loading system for light ice infested waters or waters with for example drifting nets or drifting timber.

The loading system according to the invention may be installed in different water depths, from very shallow waters (as for example 20 m or less as met in the Pechora Sea, offshore Sakhlin and the Northern Caspian Sea) to deeper water. For deeper waters, the riser protection means 20 does not need to cover the riser 18 along its entire length, only the upper part which may be subjected to ice loads. Limiting the riser protection means 20 to cover only the upper part of the riser 18 will allow the system still to be compact when stored on the sea bed 16.

The invention claimed is:

1. Flexible riser for transfer of hydrocarbons between a sea bed installation and a vessel (10) floating at sea surface, the flexible riser (18) being intended to be submerged to position below the sea level when the riser (18) is disconnected from the vessel (10) comprising the riser (18) is provided with means (20) for protecting the riser (18) from impacts and wear, caused e.g. by drifting ice, the protection means (20) covering at least the part of the riser (18) being exposed to wave and being formed of a plurality of separate elements (23), the flexible riser (18) being retractable to an in-active, retracted position below the sea level when the riser (18) is not in operation.

2. Flexible riser according to claim 1, wherein the riser protection means (20) are suspended from the vessel (10).

3. Flexible riser according to claim 1, wherein the riser protection means (20) is suspended from a submerged turret buoy (19).

4. Flexible riser according to claim 1, wherein the riser protection (20) is suspended by means of chains or wires (21).

5. Flexible riser according to claim 1, wherein the riser protection (20) is formed by a plurality of separate hollow elements (35), each being suspended from the chains or lines (21).

6. Flexible riser according to claim 5, wherein the hollow elements (35) are truncated and conical with a smaller upper diameter and a larger lower diameter or vice versa.

7. Flexible riser according to claim 1, wherein alower end of the riser protection means (20) is provided with mooring means for mooring the riser protection means (20) to the sea bed (16).

8. Flexible riser to claim 1, wherein the elements (35) forming the riser protection means (20) are stacked on top of each other when in a retracted position.

9. Flexible riser according to claim 1, wherein the riser protection means (20) may be completely retracted into sheltered position on the sea bed.

10. Flexible riser according to claim 1, wherein the riser protection means (20) may be completely retracted into a sheltered position onboard the vessel (10).

11. Flexible riser according to claim 1, wherein the riser protection means (20), at a lower end thereof, is equipped with socket (22), intended to interact with mooring means located on the sea bed (16).

12. Flexible riser according to claim 11, wherein the lower ends of the suspending chains or wires are attached to the riser socket (22).

13. Flexible riser according to claim 12, wherein the socket (22) is provided with locking means (39) for securing the socket (22) in a locked position on the mooring means.

14. Flexible riser according to claim 13, wherein the locking means 39 is equipped with a release means, enabling the socket (22) to be released from the mooring.

15. Flexible riser according to claim 11, wherein the socket (22) has an downwardly protruding, conical shape intended to interact with a corresponding opening in the mooring means, thereby preventing the socket (22) from moving upwards.

16. Flexible riser according to claim 5, wherein the elements (35) are provided with internally arranged means for minimizing possible friction or load impact between the riser (18) and the protection means (20), enabling the riser (18) to move freely within the riser protection means (20).

17. Flexible riser according to claim 1, wherein each element (35) at its lower edge, is provided with a stacking ridge (37) enabling the element (35) to be stacked on a next element (35).

* * * * *